US007073896B2

(12) United States Patent
Steiner et al.

(10) Patent No.: US 7,073,896 B2
(45) Date of Patent: Jul. 11, 2006

(54) ANHARMONIC STIMULATION OF INKJET DROP FORMATION

(75) Inventors: Thomas W. Steiner, Burnaby (CA); Scott Andrew Patten, Vancouver (CA)

(73) Assignee: Eastman Kodak Company, Rochester, NY (US)

( * ) Notice: Subject to any disclaimer, the term of this patent is extended or adjusted under 35 U.S.C. 154(b) by 226 days.

(21) Appl. No.: 10/784,987

(22) Filed: Feb. 25, 2004

(65) Prior Publication Data

US 2005/0185031 A1 Aug. 25, 2005

(51) Int. Cl.
*B41J 2/07* (2006.01)

(52) U.S. Cl. ..... 347/74

(58) Field of Classification Search ..... 347/73–75, 347/68, 82

See application file for complete search history.

(56) References Cited

U.S. PATENT DOCUMENTS

| | | | | |
|---|---|---|---|---|
| 4,047,183 | A * | 9/1977 | Taub | 347/75 |
| 4,070,679 | A * | 1/1978 | Fan et al. | 347/75 |
| 4,734,705 | A | 3/1988 | Rezanka et al. | |
| 6,070,973 | A * | 6/2000 | Sachs et al. | 347/75 |
| 6,224,180 | B1 * | 5/2001 | Pham-Van-Diep et al. | 347/2 |

FOREIGN PATENT DOCUMENTS

JP 58201662 A 11/1983

* cited by examiner

*Primary Examiner*—K. Feggins
(74) *Attorney, Agent, or Firm*—Oyer Wiggs Green & Mutala

(57) ABSTRACT

A continuous inkjet device emits a stream of fluid from nozzles. Droplet break-off is stimulated by the application of external perturbing stimulus to the stream in a manner that controls the formation of satellite drops. Satellite behavior is controlled by the use of a composite perturbing signal, composed of at least two frequencies that are not harmonically related, but are related by the ratio of small integers. In one embodiment, the use of two perturbing signals with frequencies $f_L$ and $f_H$ having a ratio of M/N, where M and N are integers, and M is not a multiple of N, and N is not a multiple of M, produces a repeating drop pattern of either M or N drops at the beat frequency of the combined signal, the constituent drops in said repeating pattern have different satellite formation characteristics. With suitable choice of phase and amplitude of the two component perturbing signals, at least one drop in the repeating pattern is observed to have favorable satellite behavior, or the absence of satellites, and is optimal for printing. This stimulation method, producing a repeating pattern of drops of different satellite behavior may then be aligned with the phase of a guard drop scheme, in which selected drops in a sequence are purposely charged and guttered in order to specifically reduce electrostatic crosstalk on print-selectable drops. By aligning the phase of the optimal printing drops of the stimulation means with the print-selectable drops of the guard drop scheme, all droplets with sub-optimal satellite behavior are thereby guttered and droplets with optimal satellite behavior are available for printing with great accuracy.

34 Claims, 5 Drawing Sheets

ANHARMONIC STIMULATION OF INKJET DROP FORMATION

CROSS-REFERENCES TO RELATED APPLICATIONS

1. Field of the Invention

The invention pertains to the field of inkjetting of fluids and, in particular, to the stimulation of inkjet fluid droplet formation in continuous inkjet systems.

2. Background of the Invention

The use of ink jet printers for printing information on a recording media is well established. Printers employed for this purpose may be grouped into those that use a continuous stream of fluid droplets and those that emit droplets only when corresponding information is to be printed. The former group is generally known as continuous inkjet printers and the latter as drop-on-demand inkjet printers. The general principles of operation of both of these groups of printers are very well recorded. Drop-on-demand inkjet printers have become the predominant type of printer for use in home computing systems, while continuous inkjet systems find major application in industrial and professional environments.

Continuous inkjet printers typically have a print head that incorporates a supply line or system for ink fluid and a nozzle plate with one or more ink nozzles fed by the ink fluid supply. A gutter assembly is positioned downstream from the nozzle plate proximate to the flight path of ink droplets. The gutter assembly catches ink droplets that are not needed for printing on the recording medium.

In order to create the ink droplets, a drop generator is associated with the print head. The drop generator influences, by a variety of mechanisms discussed in the art, the fluid stream within and just beyond the print head. This is done at a frequency that forces thread-like streams of ink, which are initially ejected from the nozzles, to be broken up into a series of ink droplets at a point within the vicinity of the nozzle plate.

The means for selecting printing drops from non-printing drops in the continuous stream in ink drops have been well described in the art. One commonly used practice is that of electrostatically charging and electrostatically deflecting selected drops. A charge electrode is positioned along the flight path of the ink droplets. The function of the charge electrode is to selectively charge the ink droplets as the droplets pass the electrodes. One or more deflection plates positioned downstream from the charge electrodes deflect a charged ink droplet either into the gutter or onto the recording media. For example, the droplets to be deflected to the gutter assembly are charged and those intended to print on the media are not charged.

It is possible to implement schemes by which the charge on (or neutrality of) droplets that are intended to print, is managed through the selective charging of droplets from neighboring nozzles, thereby controlling the induced charge on the droplet selected for printing. The charging sequence of successive drops in a stream is also used to control the electrostatic influence of charged drops on one another. These methods are generally referred to as "guard drop schemes". These schemes usually imply that the guard droplets neighboring the droplet selected for printing are not selected to print on a specific clock cycle. The implication of this kind of arrangement is that there are more guard drops than droplets selected for printing and the throughput of the system is commensurately reduced, with more ink being guttered than printed. While this may be viewed as a disadvantage, the absolute rate of droplet emission is very high, so that it is possible to maintain practical levels of overall printing throughput for the system as a whole.

The droplet generation process itself has been addressed extensively in the prior art. In its most basic form, the droplet generation process comprises creating a continuous flow of ink through a small orifice, and then employing a stimulus or perturbation to create droplets at a specific frequency. Stimulation is obtained via techniques such as pressure variations induced by heating, the piezoelectric effect or the electrohydrodynamic effect (EHD). In the simplest case, this stimulation is carried out at a fixed frequency that is calculated to be optimal for the particular liquid and matching the natural resonance breakup frequency of the fluid column ejected from the orifice. The spacing of the drops, $\lambda$, is related to the jet velocity, v, and stimulation frequency, f, by $f\lambda=v$. Drop formation on a stream of ink occurs when a perturbation signal grows on the ink column until the amplitude of the perturbation is such that a drop is formed. As described in the art, the linear theory describes a range of frequencies for which the gain, the rate of growth of a perturbation on a fluid column, is non-zero. The wavelength, $\lambda$, corresponding to the drop separation will have to obey $\lambda>\pi d$, where d is the jet diameter, if a particular frequency of stimulation is to grow on the stream and cause stimulated drop break-off.

It is found that the basic droplet creation process also causes satellite droplets to form. Satellite drops or droplets are one or more small droplets interspersed with the main stream of drops, the main drops of the stream being larger drops near the intended volume and spacing desired for optimal printing. Satellite drop formation presents a problem in inkjet printing because of unwanted drop charging effects and drop misting causing contamination of the print head environment and the resulting reduction in print quality.

The specifics of satellite formation, a non-linear process, are described in the art. Satellites form from the filaments of ink that connect the pre-formed drops in the fluid stream as it begins to breakup. The difference in the break-off time of each end of the filament and the resulting momentum exchange in the fluid filaments determine whether slow, fast or intermediate satellites are formed. Slow satellites are overtaken by the larger drop behind it and are termed rearward merging satellites. Fast satellites merge with the main drop ahead of it and are termed forward merging satellites. In the intermediate case, the satellite moves at the same velocity as the drops in the main stream and does not merge with the main drops over the course of several millimeters of travel of the drops. Different levels of stimulation cause the formation of different types of satellites: generally low excitation produces rearward merging satellites and high excitation produces forward merging satellites.

In the implementation of inkjetting systems as described above, some drops are charged as they form, and the charging potential waveform is designed to achieve proper charging of the main drops. As such, the charging potential may be changing rapidly during the formation of satellites. In this instance the charge induced on the separate satellite and main drop is indeterminate and may be significantly different from the intended charge on the main drop. The occurrence of satellite can result in the charge on some main droplets being less than intended, and that on some satellite droplets being rather large. The ultimate charge distribution on the drops is then complicated by the fact that some satellite droplets merge forward into previously emitted main droplets, or merge backwards into following main droplets. The merging of satellite droplets and main drops is problematic if the satellites completely form as separate drops prior to the break-off of the main drops into which the satellites will later merge, an instance in which the charge on the resulting merged drops is most indeterminate. This occurrence is termed a "bad merge" and is further described as either a "bad rearward merge" or a "bad forward merge" depending on whether the said first separated satellite then merges with the main drop behind it or ahead of it, respectively. The result of these effects is that some main droplets, that had been intended to be uncharged or given a specific charge, and to be printed, become at least slightly charged or have their intended charge altered. This leads to them being deflected slightly in their trajectories, and they end up printing at a point that differs significantly from the point at which they were intended to print.

Additionally, in the instance where satellites separate from the main drop after the main drop has separated from the jet, and then merge back into the drop moving forward, the behavior is termed "good forward merging", and in merging to the rear, "good rearward merging". These behaviors are termed "good" as both components of the drop are separated from the jet and exposed to the full charging cycle of the charging electrodes.

One solution that has been proposed to address the problem of the control of satellite formation is described in U.S. Pat. No. 4,734,705. The proposed solution comprises stimulating the liquid flow at both a fundamental frequency and at least one other harmonic frequency, typically the second harmonic frequency, and then adjusting the relative amplitude and phase of the at least two stimulation signals to stimulate drop formation in a region of ideal satellite formation.

With the rapid development of inkjet printing technology, the need for increased printing throughput, improved resolution, superlative droplet placement and optimal use of the inkflow has increased. The present invention seeks to address the combination of these requirements.

BRIEF SUMMARY OF THE INVENTION

A continuous inkjet device emits a stream of fluid from nozzles. Droplet break-off is stimulated by the application of external cyclical perturbing stimulus to the stream in a manner that controls the formation of satellite drops. Satellite behavior is controlled by the use of a composite cyclical perturbing signal, composed of at least two frequencies that are not harmonically related, but are related by the ratio of small integers. In one embodiment, the use of two cyclical perturbing signals with frequencies $f_L$ and $f_H$ having a ratio of M/N, where M and N are integers, and M is not a multiple of N, and N is not a multiple of M produces a repeating drop pattern of either M or N drops at the beat frequency of the combined signal, the constituent drops in said repeating pattern have different satellite formation characteristics. With suitable choice of phase and amplitude of the two component cyclical perturbing signals, at least one drop in the repeating pattern is observed to have favorable satellite behavior, or the absence of satellites, and is optimal for printing. This stimulation method, producing a repeating pattern of drops of different satellite behavior may then be aligned with the phase of a guard drop scheme, in which selected drops in a sequence are purposely charged and guttered in order to specifically reduce electrostatic crosstalk on print-selectable drops. By aligning the phase of the optimal printing drops of the stimulation means with the print-selectable drops of the guard drop scheme, all droplets with sub-optimal satellite behavior are thereby guttered and droplets with optimal satellite behavior are available for printing with great accuracy.

DETAILED DESCRIPTION OF THE PREFERRED EMBODIMENT

Figure 1:
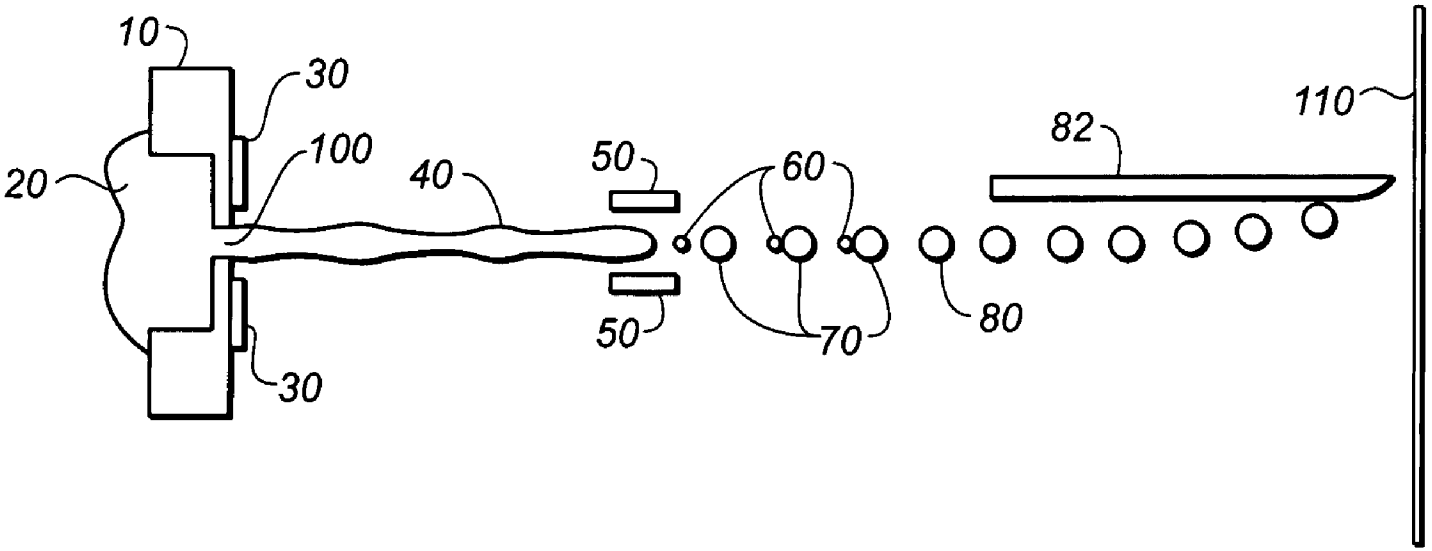
FIG. 1 is a schematic drawing of a continuous inkjet printing device showing stimulation, charging and deflection electrodes and the nature of droplet formation from an inkjet stream.

FIG. 1 is a schematic drawing of a continuous inkjet printing device. Ink 20 is delivered under pressure to an ink manifold 10 and jetted under pressure through orifice 100 producing a column of ink as a jet 40. On exiting the orifice 100 the ink passes stimulation electrodes 30, in a particular embodiment of the device, which cause the inkjet to breakup into individual drops in a controlled manner between the charging electrodes 50. This point is called the break-off point. The drop stream that forms after break-off typically has as its components satellite drops 60 and main drops 70. After some distance of travel the separate components may merge back into single drops 80 and will be either deflected to the guttering system 82 or passed for printing onto the substrate 110.

In one aspect of the present invention, we consider the matter of the stimulation required for droplet formation. Preferred methods of drop break-off stimulation in the continuous inkjet system of the present invention include thermal, electrohydrodynamic and piezo-electric. To the extent that the basic mechanisms of droplet formation are well understood and documented, these matters will not be entered upon herein in detail.

In a preferred embodiment of the present invention, the inkjet fluid is stimulated or perturbed with two cyclical perturbation signals, one at a selected lower frequency $f_L$ (the first frequency) and one at a higher frequency $f_H$ (the second frequency), which higher frequency is not a harmonic of the lower frequency. A more preferred droplet formation stimulation arrangement is that in which the higher frequency has the relationship with the lower frequency as given by equation (1):

$$f_H/f_L=M/N \tag{1}$$

where M and N are small integers, M is not an integer multiple of N and N is not an integer multiple of M. Such a selection of frequencies is referred to in the present specification as being "anharmonic".

Another constraint on the choice of frequencies is given by the well-established linear theory deriving the gain curve, which describes the gain of a growing signal on the inkjet as a function of wavenumber $\kappa=\pi d/\lambda$. For non-zero gain and growth of the perturbation frequencies on the ink stream, the wavelength of a given frequency must obey $\lambda>\pi d$. For the two frequency system of our preferred embodiment this requirement becomes $\lambda_H>\pi d$ or $\lambda_L>(M/N)\pi d$. We allow for the fact that the linear theory describing the gain curve may only be approximate in determining these wavelength limits and that in practice, when non-linearities are considered, some non-zero gain may for example exist for $\lambda_H<\pi d$.

The combined signal, herein referred to as the net cyclical perturbation, will have a waveform that is dependent on the relative amplitude and phase of the underlying cyclical perturbation signals, but in general will have the form of repeated peaks and valleys, the peaks occurring at times close to the occurrence of peaks of either the component waveform at frequency at $f_H$ or at $f_L$. The two signals will add to produce this repeating interference pattern every M cycles of the higher frequency signal or every N cycles of the lower frequency signal, at a third frequency, the beat frequency. This beat frequency is given by equation (2):

$$f_B=f_H|(1-N/M)| \tag{2}$$

It may be shown that, by using a suitable choice of relative amplitude and phase of the signals at $f_H$ and $f_L$, droplets may be produced from the fluid jet at the higher frequency, $f_H$, while the repeating pattern of satellite drop formation is produced at the rate of the beat frequency. The component droplets are formed at a period of $1/f_H$. Each recurring drop in the repeating pattern is formed at a period of $|M/(M-N)|/f_H$ or $1/f_B$ and therefore corresponding recurring drops in the repeating pattern are separated by this period. The repeating pattern at the beat frequency may include forward and rearward merging satellites as well as satellite-free drops. This repeating pattern of drops of different character, herein called the controlled satellite sequence, allows selection of at least one recurring drop in the pattern that is most suitable for charge control and therefore for quality printing. It is advantageous to gutter the remaining droplets formed in the repeating pattern of the controlled satellite sequence, as they will be less than optimal in terms of satellite formation, merging behavior, and charge control.

The method of selecting one drop from the repeating pattern of the controlled satellite sequence effectively employs a print-selectable droplet generation rate that equals the beat frequency of the combined perturbation signal. The term "print-selectable drops" is used here to describe those drops in the controlled satellite sequence that have optimum character for accurately determining transferred charge and which are chosen on the basis of this drop quality to be available for printing. The term "print-selected drops" is used here to describe print-selectable drops that are used for printing, based on the data in the print data stream. In the present specification, drops may have one of two "selectability states", namely that they are either print-selectable or they are not print selectable. In general there is a set of m sequential drops created during every period of the net cyclical perturbation, and the n-th drop in every set of m sequential drops has the same selectability state, wherein n=1,2,3 . . . m.

By way of example, equation (2) predicts that if M=4 and N=3, then $f_H=4/3f_L$ and the beat frequency is $f_B=f_H/4$. This implies that a repeating pattern of four drops can be generated (each component drop of the pattern forming at a period $1/f_H$) and that with suitable choice of phase and amplitude of the component cyclical perturbation signals, at least one of the four drops in that sequence (each characteristic recurring drop formed with a period $4/f_H$) will be suitable for high reliability, high accuracy printing due to the favorable merging characteristics, or the absence of the satellites associated with that specific drop. If more than one drop in this sequence were selected for use in printing due to its favorable satellite formation characteristics, the print-selectable drop generation rate would lie between $f_H/4$ and $f_H$ depending on the number of drops used. If k drops of the pattern were selected for printing then the effective print-selectable drop generation rate would be $kf_H/4$. Corresponding print-selectable drops from consecutive periods of the net cyclical perturbation are separated by a period of $1/f_B$. The term "corresponding" is used here to describe the spatially sequential first print-selectable drop from the second and later periods, as "corresponding" to the spatially sequential first print-selectable drop of the first period. It is preferable to have a situation wherein there are no two print-selectable drops adjacent to each other within the linear sequence of drops. This minimizes the possibility of data-related crosstalk between print-selectable drops, which would otherwise occur via electrostatic induction.

It can further be shown that the droplet formation may be optimized by selection of the phase relationship and relative amplitudes of the lower frequency cyclical perturbation signal and the higher frequency cyclical perturbation signal such that a variety of satellite drop behaviors are evident in the pattern.

In like manner to the instance described above, it may be shown that, by using a suitable choice of relative amplitude and phase of the signals at frequencies $f_H$ and $f_L$, droplets may be produced from the fluid jet at the lower frequency, $f_L$, while the repeating pattern of satellite drop formation is produced at the rate of the beat frequency. The component droplets are formed at a period of $1/f_L$, whereas each recurring drop in the repeating pattern is formed at a period of $|N/(M-N)|/f_L$. In a manner similar to that described above, this repeating pattern of drops of different character allows selection of at least one recurring drop in the pattern that is most suitable for charge control and therefore for quality printing. Comparing the two cases in which drop generation occurs at either at $f_H$ or $f_L$ it is noted that in the instance of the selection of a single print-selectable drop from each respective pattern arising from each case, that the print-selectable droplet generation rate equals the common beat frequency in each case, but that fewer drops are guttered in the case of drop generation at $f_L$.

It may further be shown that the benefits of the control of satellite formation in the drop stream arising from the use of anharmonic stimulation are obtained with the use of at least two frequencies of non-harmonic relationship.

This invention is not only novel in employing an anharmonic stimulation signal to produce drops most suitable for printing, but also allows the charging sequence of a given guard drop scheme to be matched with the stimulation scheme.

Given that the use of a guard drop scheme implies that a subset of drops generated by a given nozzle would be guttered as non-printing drops, it is possible, by the use of the anharmonic stimulation scheme described herein, to select a combination of cyclical perturbation frequencies with associated integer multipliers, M and N, and the relative phase and amplitude of the cyclical perturbation signals, to ensure a match to the print-selectable drop sequence of a specific guard drop scheme.

Figure 2:
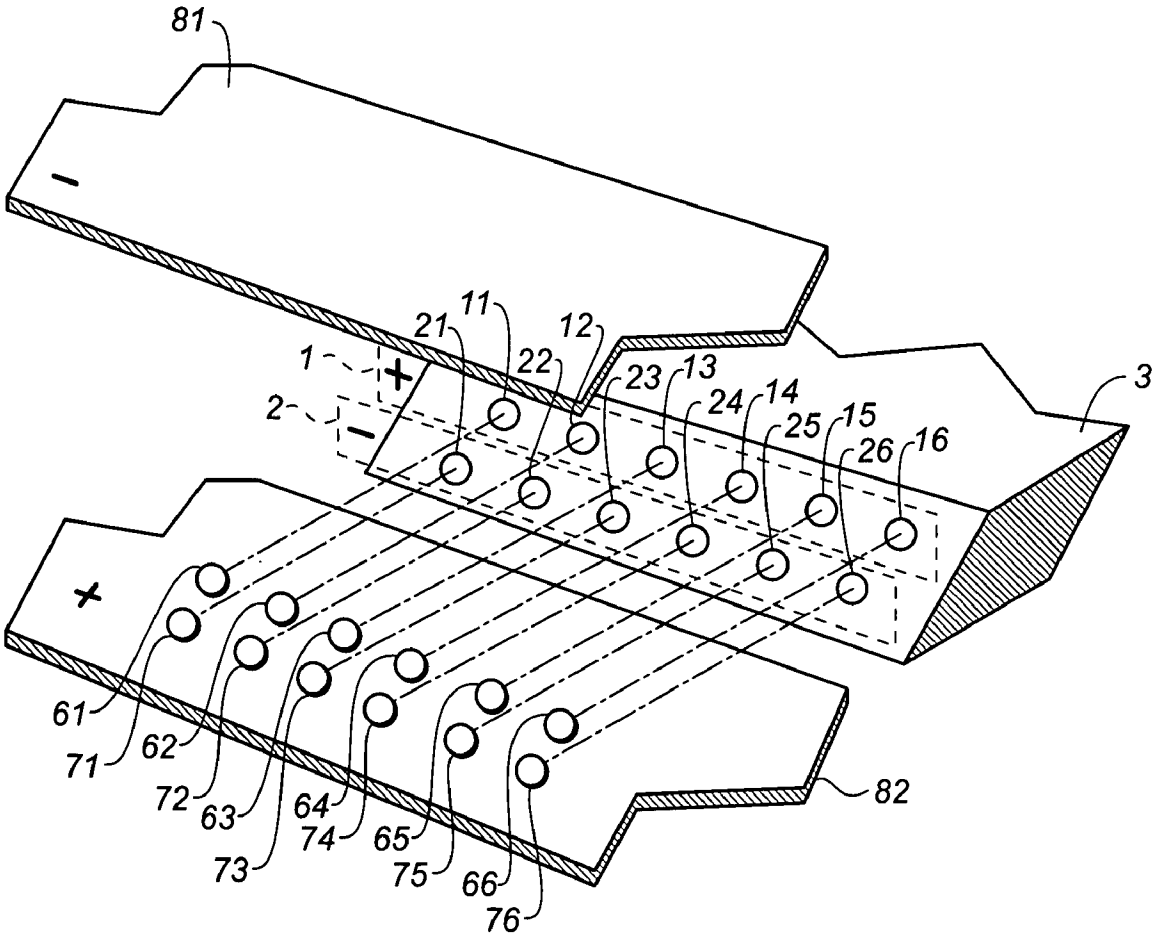
FIG. 2 shows an inkjet print head with two linear inkjet nozzle arrays and the oppositely charged guttering electrodes of the invention.

A detailed description of preferred embodiments relating to the use of guard drop schemes in a two row array of nozzles follows. FIG. 2 shows a preferred embodiment of the present invention. Linear inkjet nozzle array 1 is comprised of a first plurality of inkjet nozzles, of which nozzle 11, 12, 13, 14, 15 and 16 are chosen as representative examples for the purposes of explaining the present invention. Linear inkjet nozzle array 2 is comprised of a second plurality of inkjet nozzles, of which inkjet nozzles 21, 22, 23, 24, 25 and 26 are chosen as representative examples for the purposes of explaining the present invention. In order to double the printing resolution, linear inkjet nozzle array 1 and linear inkjet nozzle array 2 are positioned parallel to each other and mutually shifted by half of the separation between adjacent nozzles within a linear inkjet nozzle array.

For the sake of clarity, the present invention shall be described at the hand of a preferred embodiment in which all nozzles on linear inkjet nozzle array 1 may generate either neutral or positively charged inkjet fluid droplets. Conversely, all the nozzles on linear inkjet nozzle array 2 may generate either neutral or negatively charged inkjet fluid droplets. The charge on an inkjet fluid droplet is made neutral when the droplet is selected to print upon the printing medium. When an inkjet fluid droplet is selected for guttering, it is charged, the charge being positive for droplets emanating from linear inkjet nozzle array 1 and negative for droplets emanating from linear inkjet nozzle array 2. The means of charging inkjet fluid droplets in continuous inkjet printing systems are well documented in the prior art and shall not be further discussed herein.

FIG. 2 shows the disposition of the guttering or deflection electrodes 81 and 82 relative to the inkjet nozzle arrays. Nozzles 11 to 16 of linear inkjet nozzle array 1 produce fluid droplets 61 to 66. If one of these droplets from linear inkjet nozzle array 1 were to be neutral, it would be allowed to pass through along its trajectory, but if it were charged (array 1 always being limited in the present embodiment to creating positively charged or neutral droplets), the droplet would be deflected towards guttering electrode 81, which is negatively charged. If one of the droplets from linear inkjet nozzle array 2 were to be neutral, it would be allowed to pass through along its trajectory, but if it were charged (array 2 always being limited in the present embodiment to creating negatively charged or neutral droplets), the droplet would be deflected towards guttering electrode 82, which is positively charged. In this way, all inkjet fluid droplets emanating from inkjet nozzle arrays 1 and 2 are either allowed to pass along their trajectory towards the print medium when neutral, or are deflected to a guttering system (not shown) due to the electrostatic field between deflection electrodes 81 and 82.

Figure 3:
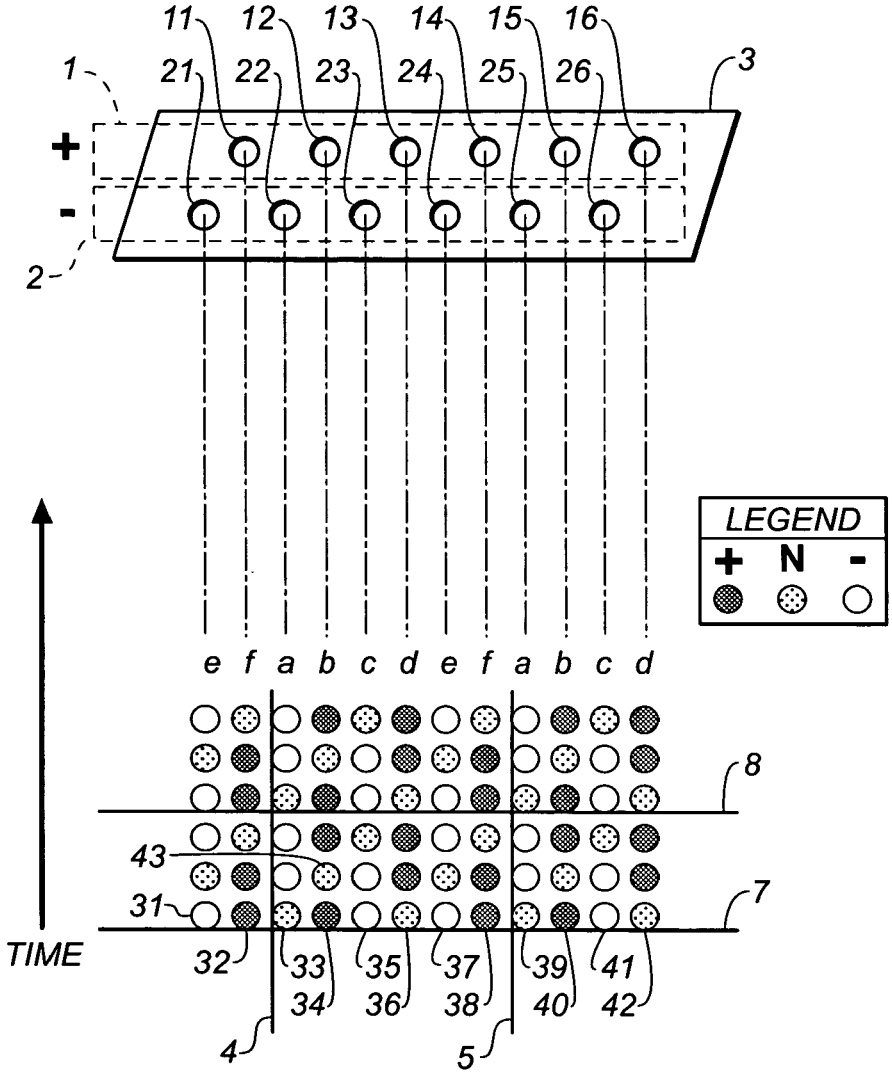
FIG. 3 shows a droplet charging scheme resulting from implementation of the present invention.

Turning now to FIG. 3, we consider inkjet nozzle 22 of inkjet nozzle array 2. We denote its charging sequence by the letter a. We consider the case where nozzle 22 produces a neutral inkjet fluid droplet with the intent of having this droplet potentially available for printing a dot on the printing medium (not shown). We shall refer to such a droplet as a print-selectable droplet and to the corresponding nozzle of interest as a print-selectable inkjet nozzle. In order to minimize the crosstalk between droplets emanating from nearest neighbor nozzles 21, 11, 12 and 23, nozzles 21 and 23 produce at the same time droplets that are negatively charged and nozzles 11 and 12 produce droplets that are positively charged. The net induced effect of the two nearest neighbor positive and two nearest neighbor negative charging electrodes of substantially equal magnitude on the droplet produced by nozzle 22 is thereby strongly reduced. The sum of the induced charges on the print-selectable droplet is substantially zero or a small predetermined value, said value depending in part on the nozzle-to-nozzle and inter-row spacing of the arrays. The use of the neighboring nozzle charging potentials to minimize changes in the induced charge on a specific drop, typically a print-selectable drop, is referred to as a "guard drop scheme". The charged drops, which surround the print-selectable drop, are referred to as "guard drops". In the absence of this "guard drop" charging sequence, there can be substantial electrostatic charges induced on the droplet emitted from nozzle 22. On the same clock cycle of the drop generation clock where the print-selectable drop 33 at nozzle 22 is uncharged, the next nozzle available to produce a neutral printing drop under this scheme would be print-selectable drop 36 at nozzle 13, which would be "guarded" from induced charge by the combined effect of positive charges at nozzles 12 and 14 on array 1, and negative charges at nozzles 23 and 24 on array 2. Electrostatic crosstalk effects on print-selectable nozzle 22 due to the different possible charge states on nozzle 13, (neutral for printing, positive for non-printing), also exist and can be managed.

The generation of drops by this scheme, creates, on each clock cycle, 2-dimensional sets of drops that move towards the surface to be printed upon. In principle, therefore, a plurality of continuous streams of liquid is perturbed into a plurality of linear sequences of drops. Drops from nearest neighbor nozzles to a given print-selectable nozzle, thereby constitute nearest neighbor drops to the drop from the print-selectable nozzle.

The linear repeat period of inkjet print head 3 for one guard drop charging scheme described in this particular embodiment has every third nozzle in the combined pattern from both linear inkjet nozzle array 1 and linear inkjet nozzle array 2 producing a neutral droplet. This may be most easily seen by considering the droplet charges produced at the same time by nozzles 11 to 16 and 21 to 26 in FIG. 3. Nozzles 11, 12, 13, 14, 15 and 16 produce droplets 32, 34, 36, 38, 40 and 42, while nozzles 21, 22, 23, 24, 25 and 26 produce droplets 31, 33, 35, 37, 39 and 41. Neutral droplets are shown as hatched, positive droplets are shown as solid, and negative droplets are shown as empty in FIG. 3. With nozzle 22 producing a neutral droplet, the nearest nozzle that may again be neutral, while maintaining the minimum crosstalk scheme described above, is nozzle 13 of Inkjet nozzle array 1. Under these circumstances the droplets produced by the various nozzles of inkjet nozzle arrays 1 and 2 have the charges as shown on droplets 31 to 42 in FIG. 3 at the time represented by line 7. Neutral drops are found at positions a, d, a, d . . . . Note that in this schematic the droplets are shown in a single row for the sake of clarity only, whereas the drop placement pattern produced on the recording medium being printed upon would depend on the drop generation rate, and the relative speed between the array and the medium. Also, all print-selectable drops in accordance with this guard drop scheme are indicated as neutral in the figures, whereas in actual practice, in a printing device, only print-selected drops as required by print data would be left uncharged and reach the recording medium, all others being guttered, including those print-selectable drops not required by the print data.

In the forgoing sections, the interrelationship between the charging of the different nozzles in linear inkjet nozzle arrays 1 and 2 were explained for the case where example nozzle 22 was selected for printing and was therefore made neutral. On the next clock cycle of the drop generation frequency, the next nozzle selected for printing might be nozzle 12, followed by nozzle 23. When nozzle 12 is selected to print, droplets from nozzles 22 and 23 have to be negatively charged while droplets from nozzles 11 and 13 have to be positively charged. This is depicted by the second row of inkjet droplet charge states in FIG. 3, indicated as being printed at a later time than the numbered first row. The third row of inkjet droplet charge states represents the third and last step in the nozzle print sequence scheme described herewith. In this case nozzle 23 is producing a neutral droplet while nozzles 22 and 24 produce negative droplets and nozzles 12 and 13 produce positive droplets. This is but one arrangement and it will be obvious to practitioners in the field that other nozzle print sequence schemes are possible.

It is evident that the pattern may be repeated from this point onwards in cycles of three charge state selections. In this particular nozzle print sequence scheme, the droplets from nozzles 22, 12, 23, 13, 24, and 14 respectively have charge state sequences a, b, c, d, e, and f, and form a unit cell of charge states in the linear dimension delineated by lines 4 and 5 in FIG. 3, and a repeating pattern of neutral printing drops at a period in the linear dimension of every three nozzles along both combined arrays (also every three nozzles on either array). In respect of time, the charge state sequence of a particular nozzle repeats with every third droplet emitted by that nozzle. The permissible sequence of droplets bounded by lines 7 and 8 in FIG. 3 is therefore repeated. This cyclic arrangement of 3 charge states in both the linear and temporal dimension is referred to herein as a 1-in-3, or 1:3 guard drop scheme.

Figure 4:
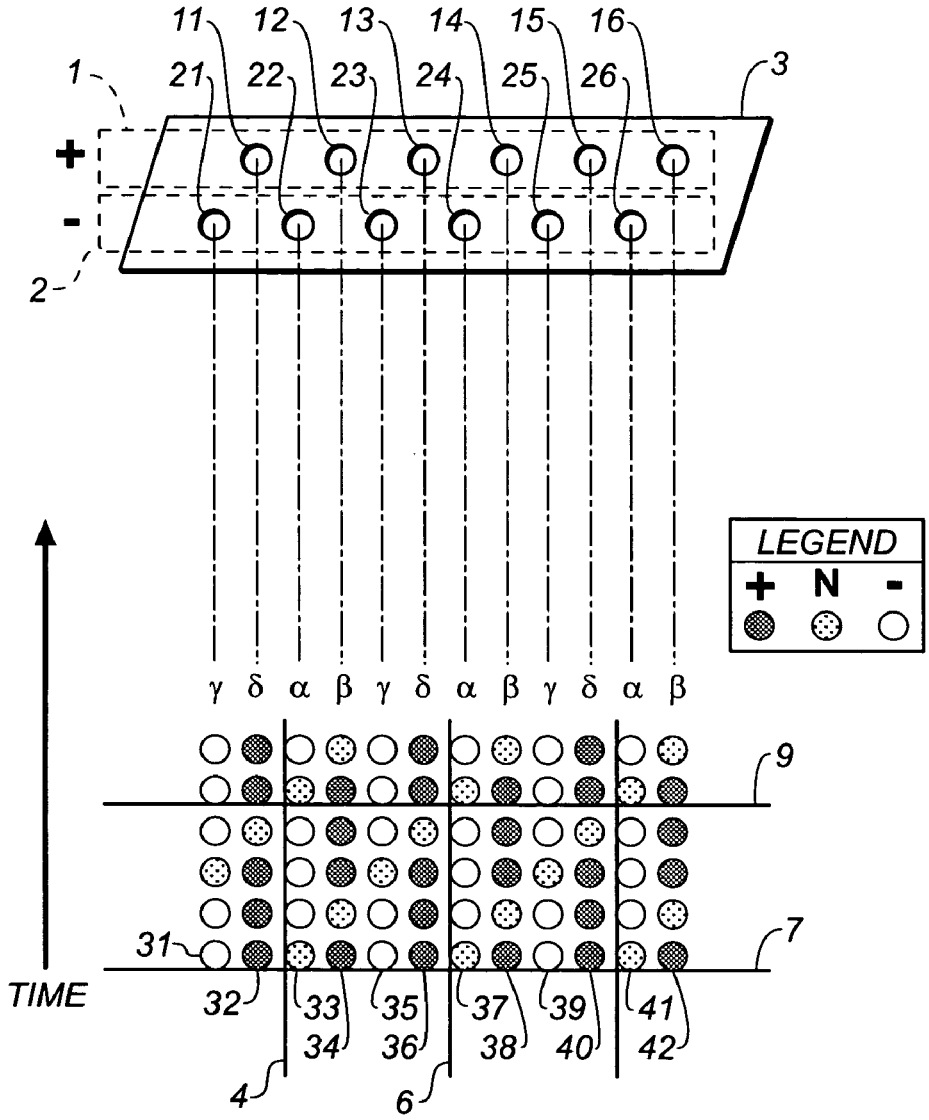
FIG. 4 shows another embodiment of a droplet charging scheme resulting from implementation of the present invention.

In another preferred embodiment of the invention the charge state sequence repeats in a pattern of 4 charge states, with every fourth drop emitted from a given nozzle being available for selection as a neutral printing drop. This cyclic arrangement of charge states in referred herein as a 1-in-4 or 1:4 guard drop scheme and is shown in FIG. 4. In said 1:4 guard drop scheme, with the first print-selectable nozzle chosen to be nozzle 22 of array 2, the next available drop to print on the same clock cycle is on array 2 at nozzle 24. In this scheme, when array 2 has a print-selectable drop, all of the nozzles on array 1 are charged positively (none are available for printing), and nozzle 23 on array 2 is charged negatively. As in the 1:3 guard drop scheme, the negative charges on nozzles 21 and 23 and the positive charges on nozzles 11 and 12, balance to produce a net induced charge on the drop formed at nozzle 22 that is substantially zero, or a small predetermined value, the value depending in part on the nozzle-to-nozzle and inter-row spacing of the arrays. Electrostatic crosstalk effects on print-selectable nozzle 22 due to the different possible charge states on nozzle 24, (neutral for printing, negative for non-printing), also exist, and can be managed.

It is evident that the pattern may be repeated in time as well as linearly in cycles of four charge state selections. In this particular nozzle print sequence scheme, the droplets from nozzles 22, 12, 23, and 13, respectively have charge state sequences $\alpha$, $\beta$, $\gamma$ and $\delta$, and form a unit cell of the arrangement a delineated in space by lines 4 and 6 in FIG. 4., and a repeating pattern of neutral printing drops at a period in the linear dimension of every four nozzles along both combined arrays (every two nozzles on either array). In respect of time, the charge state sequence of a particular nozzle repeats with every fourth droplet emitted by that nozzle. The permissible sequence of droplets bounded by lines 7 and 9 in FIG. 4 is therefore repeated in time. In a general case, it is possible to implement a 1-in-X or 1:X guard drop scheme, where X is an integer greater than 1. Again, it is preferable to have a situation wherein there are no two print-selectable drops adjacent to each other within any given linear sequence of drops in order to minimize the possibility of data-related crosstalk between print-selectable drops.

By way of example of the simultaneous use of anharmonic stimulation and the guard drop scheme, consider the case shown in FIG. 3. In the guard drop scheme of FIG. 3 every third drop emitted from a nozzle is a print-selectable drop and the remaining drops are unused in printing and are intended to be guttered. Employing the anharmonic stimulation described herein with the choice of N=3, M=4, and with a suitable choice of phase and amplitude of those two frequency components, can produce a 3-drop repeating controlled satellite sequence in which one of the drops has satellite behavior that makes it best suited for printing. The optimal printing drop of the controlled satellite sequence is then chosen as the print-selectable drop and is placed in the appropriate phase relationship in the sequence of the guard drop scheme charge generator. The process of placing the physical drop pattern of the controlled satellite sequence in the appropriate phase relationship with the guard drop scheme data signals delivered by the charging electrodes is herein referred to as "aligning the phase of the stimulation and the guard drop scheme". Aligning the phase of the optimal print drops arising from the anharmonic stimulation with the print-selectable drops of the guard drop scheme permits printing with the drops best suited for charge control, and also ensures guttering of those drops whose satellite behavior makes them less suitable for printing.

By way of further example, the 3-drop repeating pattern referred to above can also be produced by the choices N=2, and M-3 with suitable choice of phase and amplitude of those two frequency components.

Similarly in the case of FIG. 4 wherein every fourth drop emitted from a nozzle is a print-selectable drop and the remaining drops are unused in printing and are guttered, the choice of N=3, M=4, with a suitable choice of phase and amplitude of those two frequency components, can produce a 4-drop repeating pattern in which one of the drops has satellite behavior that makes it best suited for printing. Said optimal printing drop is then placed in the appropriate phase relationship in the sequence of the guard drop scheme charging sequence, aligning the phase of the controlled satellite sequence such that the optimal print drop arising from the anharmonic stimulation coincides with the print-selectable drop of the guard drop scheme. In general it is therefore possible to choose M and N to produce a print selectable drop sequence that matches a 1:X guard drop scheme.

Figure 5:
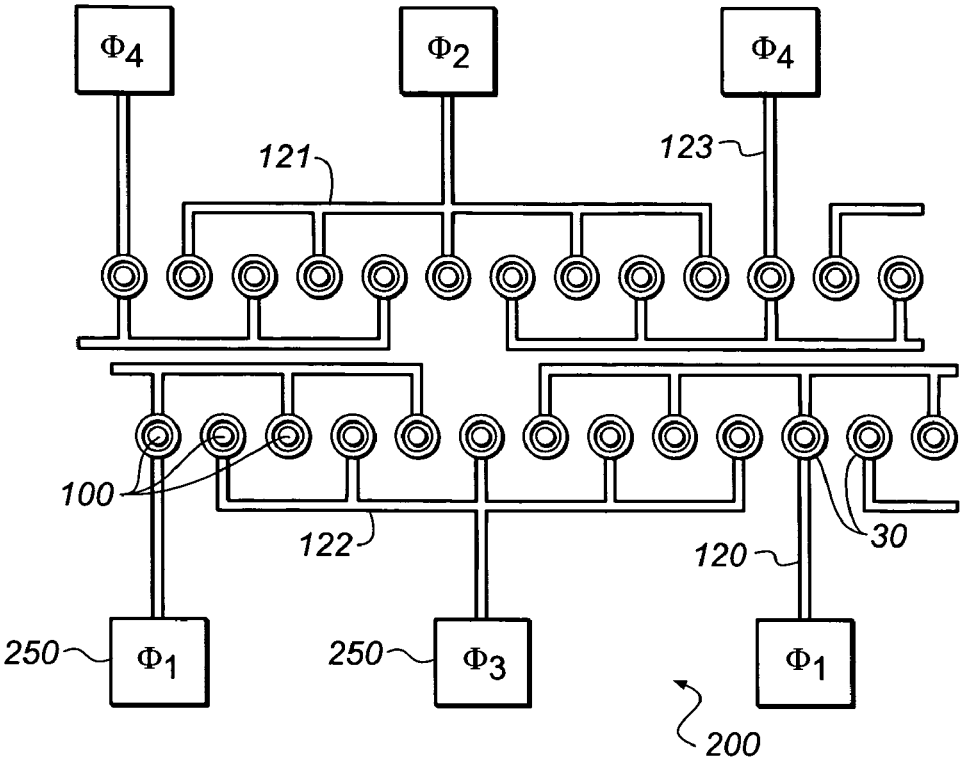
FIG. 5 is a schematic of one embodiment of a stimulation electrode connection and arrangement.

Alignment of the phase of the controlled satellite sequence produced by anharmonic frequency stimulation with the phase of the print selectable drops of the guard drop scheme requires multiple phases of stimulation delivered to the print head nozzles, as the guard drop schemes signals described are provided in multiple phases to the charge electrodes. Each stimulation electrode 30 surrounding each nozzle may be connected individually to a source of stimulation waveform. Alternatively, two or more stimulation electrodes may be connected together and to a common source of stimulation waveform. The benefit of the latter approach is that for arrays of large numbers of closely spaced nozzles, such as those found in high quality inkjet printing heads, accessing electrical connections to each individual stimulation electrode, through wire bonding for example, may be difficult given the small dimensions of the structures on the print head. Connecting multiple nozzles through conductive traces connected to one connection point allows a larger distance between electrical connection points thereby increasing accessibility. FIG. 5 illustrates a specific wiring arrangement for the 1:4 case. A portion of the two row nozzle plate 200 is shown with nozzles 100 arrayed in two linear rows. Stimulation electrodes 30 are connected together by conductive elements 120, 121, 122, 123 each connected to different electrical connection points, driven by four separate phases of the stimulation signal such that the patterns are separated by 90 degrees which would correspond to pattern sequences α, β, γ and δ in FIG. 4.

Figure 6:
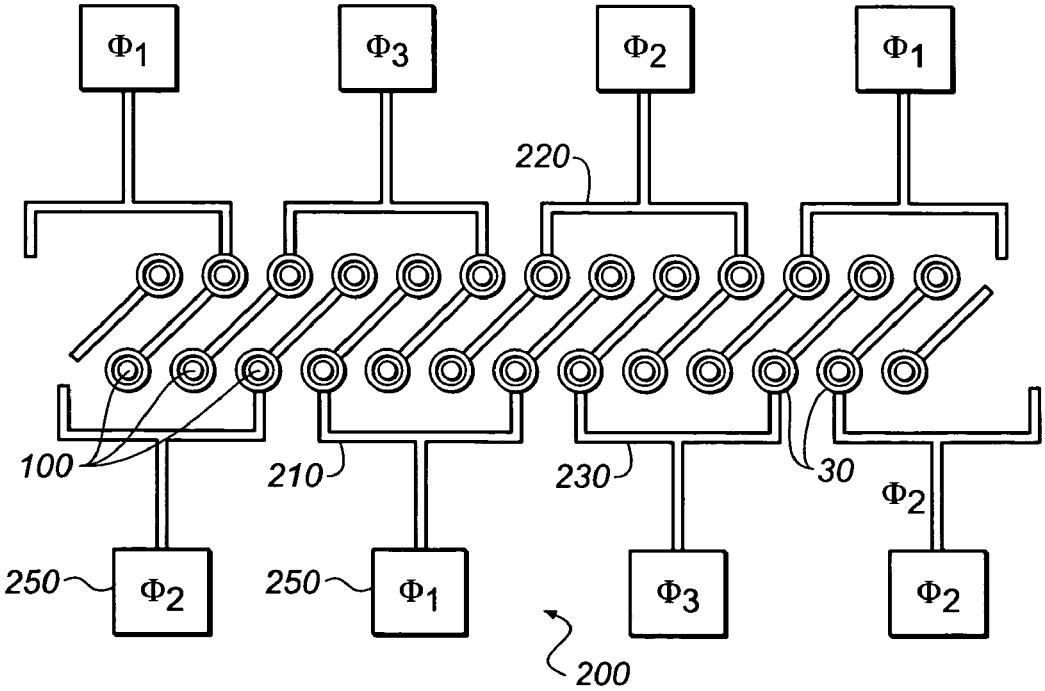
FIG. 6 is a schematic of one embodiment of another stimulation electrode connection and arrangement.

FIG. 6 illustrates a specific wiring arrangement for the 1:3 case. A portion of the two row nozzle plate 200 is shown with nozzles 100 arrayed in two linear rows. Stimulation electrodes 30 are connected together by conductive elements 210, 220, 230 each connected to different electrical connection points 250, and driven by three separate phases of the stimulation signal such that the patterns are separated by 120 degrees which would correspond to pattern sequences a, b, c, or d, e, f in FIG. 3. The stimulation electrode connection arrangement shown in FIG. 6 connects four nozzles to each bonding pad, which is the maximum number of stimulation electrodes that can be connected in the 1-in-3 case without resorting to the use of electrical crossovers.

As a further extension of the present invention, it is possible to have not only the primary lower frequency $f_L$ and the primary higher frequency $f_H$, but at least one additional cyclical perturbation signal having frequency anharmonically related to $f_L$ and $f_H$. The adjustment of the phase and amplitude of the additional anharmonic perturbation signal allows the forwards and backwards merging of satellite drops to be controlled for those drops that are not optimal printing drops by virtue of the primary beat frequency. This allows a further degree of control over the quality of drops formed in the system.

In a more general implementation of the present invention, any number of further anharmonic perturbation signals may be applied in order to manipulate drop formation and satellite drop formation by the mechanism described here.

There have thus been outlined the important features of the invention in order that it may be better understood, and in order that the present contribution to the art may be better appreciated. Those skilled in the art will appreciate that the conception on which this disclosure is based may readily be utilized as a basis for the design of other methods and apparatus for carrying out the several purposes of the invention. It is most important, therefore, that this disclosure be regarded as including such equivalent methods and apparatus as do not depart from the spirit and scope of the invention.

What is claimed is:

1. A method for converting a continuous stream of liquid into a linear sequence of drops, the method comprising the steps of:

a. imposing on the stream of liquid a first cyclical perturbation having a first frequency $f_1$ and b. simultaneously with the first cyclical perturbation, imposing on the stream of liquid at least one further cyclical perturbation to create a net cyclical perturbation, the at least one further cyclical perturbation having frequency $f_k$, wherein, i. $f_1/f_k$=M/N, M and N are integers, and ii. M is not an integer multiple of N and iii. N is not an integer multiple of M.

2. The method of claim 1, wherein there is a set of m sequential drops created during every period of the net cyclical perturbation, and the n-th drop in every set of m sequential drops has the same selectability state, wherein n=1,2,3 . . . m.

3. The method of claim 2, comprising the further step of removing from within each set of m sequential drops at least one drop that is not print-selectable.

4. The method of claim 3, wherein there are no two print-selectable drops adjacent to each other within the linear sequence of drops.

5. The method of claim 3, wherein the quality of print-selectable drops is determined by at least one of:

a. the phase difference between the first cyclical perturbation and any one of the at least one further cyclical perturbation, b. the phase difference between any two of the at least one further cyclical perturbation, c. the amplitude of the first cyclical perturbation, and d. the amplitude of any one of the at least one further cyclical perturbation.

6. A method for converting a first plurality of continuous streams of liquid into a second plurality of linear sequences of drops, the method comprising the steps of:

a. imposing on each member of the first plurality a first cyclical perturbation having a first frequency $f_1$ and b. simultaneously with the first cyclical perturbation, imposing on each member of the first plurality at least one further cyclical perturbation to create a net cyclical perturbation, the at least one further cyclical perturbation having frequency $f_k$, wherein, i. $f_1/f_k$=M/N, M and N are integers, and ii. M is not an integer multiple of N and iii. N is not an integer multiple of M.

7. The method of claim 6, wherein there is a set of m sequential drops created during every period of the net cyclical perturbation in each member of the first plurality, and the n-th drop in every set of m sequential drops has the same selectability state, wherein n=1,2,3 . . . m.

8. The method of claim 7, comprising the further step of removing from within each set of m sequential drops at least one drop that is not print-selectable.

9. The method of claim 8, wherein there are no two print-selectable drops adjacent to each other within the linear sequence of drops.

10. The method of claim 8, wherein the quality of print-selectable drops is determined by at least one of:

a. the phase difference between the first cyclical perturbation and any one of the at least one further cyclical perturbation, b. the phase difference between any two of the at least one further cyclical perturbation, c. the amplitude of the first cyclical perturbation, and d. the amplitude of any one of the at least one further cyclical perturbation.

11. The method of claim 10, comprising the further steps of a. selecting at least one print-selectable drop from one member of the second plurality of linear sequences of drops, b. establishing charges on all the nearest neighbor drops to the at least one print-selectable drop within adjacent members of the second plurality of linear sequences of drops to make the sum of the induced charge on the at least one print-selectable drop a small predetermined value.

12. The method of claim 11, wherein the predetermined value is substantially zero.

13. The method of claim 10, wherein the phase of the net cyclical perturbation is not the same for all members of the first plurality.

14. The method of claim 10, wherein M and N are chosen to produce a print selectable drop sequence that matches a 1:X guard drop scheme.

15. The method of claim 14, wherein the 1:X guard drop scheme is a 1:4 guard drop scheme.

16. The method of claim 14, wherein the 1:X guard drop scheme is a 1:3 guard drop scheme.

17. The method of claim 16 applied in an inkjet printer, the inkjet printer comprising inkjet nozzles electrically connected to bonding pads by conductive traces, each bonding pad is connected to four inkjet nozzles, the conductive traces to the four inkjet nozzles not crossing over one another.

18. A method for converting a continuous stream of liquid into a linear sequence of drops, the method comprising the steps of:

a. imposing on the stream of liquid a first cyclical perturbation having a first frequency $f_1$ and b. simultaneously with the first cyclical perturbation, imposing on the stream of liquid a second cyclical perturbation having frequency $f_2$ to create a net cyclical perturbation, wherein, i. $f_1/f_2$=M/N, M and N are integers, and ii. M is not an integer multiple of N and iii. N is not an integer multiple of M.

19. The method of claim 18, wherein there is a set of m sequential drops created during every period of the net cyclical perturbation, and the n-th drop in every set of m sequential drops has the same selectability state, wherein n=1,2,3 . . . m.

20. The method of claim 19, comprising the further step of removing from within each set of m sequential drops at least one drop that is not print-selectable.

21. The method of claim 20, wherein there are no two print-selectable drops adjacent to each other within the linear sequence of drops.

22. The method of claim 20, wherein the quality of print-selectable drops is determined by at least one of:

a. the phase difference between the first cyclical perturbation and the second cyclical perturbation, b. the amplitude of the first cyclical perturbation, and c. the amplitude of the second cyclical perturbation.

23. A method for converting a first plurality of continuous streams of liquid into a second plurality of linear sequences of drops, the method comprising the steps of:

a. imposing on each member of the first plurality a first cyclical perturbation having a first frequency $f_1$ and b. simultaneously with the first cyclical perturbation, imposing on each member of the first plurality a second cyclical perturbation having frequency $f_2$ to create a net cyclical perturbation, wherein i. $f_1/f_2$=M/N, M and N are integers, ii. M is not an integer multiple of N and iii. N is not an integer multiple of M.

24. The method of claim 23, wherein there is a set of m sequential drops created during every period of the net cyclical perturbation in each member of the first plurality, and the n-th drop in every set of m sequential drops has the same selectability state, wherein n=1,2,3 . . . m.

25. The method of claim 24, comprising the further step of removing from within each set of m sequential drops at least one drop that is not print-selectable.

26. The method of claim 25, wherein there are no two print-selectable drops adjacent to each other within the linear sequence of drops.

27. The method of claim 25, wherein the quality of print-selectable drops is determined by at least one of:

a. the phase difference between the first cyclical perturbation and the second cyclical perturbation, b. the amplitude of the first cyclical perturbation, and c. the amplitude of the second cyclical perturbation.

28. The method of claim 27, comprising the further steps of a. selecting at least one print-selectable drop from one member of the second plurality of linear sequences of drops, b. establishing charges on all the nearest neighbor drops to the at least one print-selectable drop within adjacent members of the second plurality of linear sequences of drops to make the sum of the induced charge on the at least one print-selectable drop a small predetermined value.

29. The method of claim 28, wherein the predetermined value is substantially zero.

30. The method of claim 27, wherein the phase of the net cyclical perturbation is not the same for all members of the first plurality.

31. The method of claim 27, wherein M and N are chosen to produce a print selectable drop sequence that matches a 1:X guard drop scheme.

32. The method of claim 31, wherein the 1:X guard drop scheme is a 1:4 guard drop scheme.

33. The method of claim 31, wherein the 1:X guard drop scheme is a 1:3 guard drop scheme.

34. The method of claim 33 applied in an inkjet printer, the inkjet printer comprising inkjet nozzles electrically connected to bonding pads by conductive traces, each bonding pad is connected to four inkjet nozzles, the conductive traces to the four inkjet nozzles not crossing over one another.

* * * * *